US005481948A

United States Patent [19]

Zerkovitz

[11] Patent Number: 5,481,948

[45] Date of Patent: Jan. 9, 1996

[54] TOOL FOR TIGHTENING FOR SLACKENING A THREADED MEMBER

[75] Inventor: Jean-Paul Zerkovitz, Lardy, France

[73] Assignee: Facom, Morangis Cedex, France

[21] Appl. No.: 224,547

[22] Filed: Apr. 7, 1994

[30] Foreign Application Priority Data

Apr. 7, 1993 [FR] France ..... 93 04142

[51] Int. Cl.[6] ..... B25B 13/00

[52] U.S. Cl. ..... 81/186; 81/436; 81/121.1

[58] Field of Search ..... 81/121.1, 186, 81/436

[56] References Cited

U.S. PATENT DOCUMENTS 3,903,764 9/1975 Andersen .
3,908,488 9/1975 Andersen .
4,930,378 6/1990 Colvin .

FOREIGN PATENT DOCUMENTS 0156681 10/1985 European Pat. Off. .

*Primary Examiner*—James G. Smith
*Attorney, Agent, or Firm*—Wenderoth, Lind & Ponack

[57] ABSTRACT

Each side of an active head, having a roughly polygonal cross-section, of a tool includes two half-sides, active zones of which are asymmetrical with respect to each other relative to the axial mid-plane such side, so as to apply, to the driven profile, a greater torque in one direction compared to the other for a given stress experienced by the tool.

8 Claims, 5 Drawing Sheets

TOOL FOR TIGHTENING FOR SLACKENING A THREADED MEMBER

BACKGROUND OF THE INVENTION

The present invention relates to a tool for tightening and slackening a driven threaded member possessing a polygonal driven profile, of the type comprising an active head, the cross-section of which has a roughly polygonal shape.

The invention applies both to female tools intended to drive a male nut and to male tools intended to drive a screw, the head of which has a polygonal recess.

Available tools possess approximately polygonal profiles which are symmetrical with respect to the two directions of rotation. Consequently, a given stress experienced by the tool corresponds to both the same torque and the same stress applied to the driven member, whether in the direction of tightening or in that of slackening.

More specifically, the many profiles provided for tightening/slackening tools (commercial names: Snap-On, Facom, Kaynar, Wera, Kevalar, etc.) are aimed at obtaining as Judicious a compromise as possible between, on the one hand, the stress induced in the male element and, on the other hand, the stress for bursting the female profile, especially when the latter is the profile of the tool.

Now, in practice, the conditions to be complied with are not generally the same in both directions of rotation. For example, it is absolutely essential to protect a nut which is being tightened, whereas it is often acceptable to damage an obstinate nut which is being untightened, for example if it is rusty or jammed, provided that it is successfully untightened.

Moreover, it may be necessary, in certain cases, to be able to develop, with a given tool, a tightening torque markedly greater than the usual tightening torques.

SUMMARY OF THE INVENTION

The object of the invention is to provide a tool better suited to the actual various use requirements.

For this purpose, the subject of the invention is a tool of the aforementioned type, characterized in that at least two sides of the cross-section of the head of the tool are each formed by two half-sides, the active zones of which are constituted, for both directions of rotation, by fillets or sharp edges interacting with plane faces of the polygonal profile, and have general shapes which are mutually asymmetrical with respect to the axial mid-plane of such side, so that, for a given torque applied to the tool, the stresses induced in the tool are smaller in a first direction than in the other, whereas, conversely, the stresses induced in the driven member are larger in such first direction than in the other, which makes it possible to apply, to the driven member, a greater torque in the first direction than in the other direction before destroying the head of the tool.

According to other characteristics:

the asymmetry defines, in the first direction, a lever arm greater than that corresponding to the other direction;

the difference in lever arm is obtained by a difference in distance to the axial mid-plane of the two contact zones and/or by a difference in inclination of the application of the force with respect to this plane;

the contact of the side with the driven profile is brought about by a surface of smaller radius in the first direction than in the other direction;

the contact surface in the first direction is reduced to a sharp edge;

the tool is one having an imposed direction of use, especially one of a socket-spanner, tube-wrench, bent-spanner, offset-wrench, screwdriver, Allen-key or male-adapter type, the first direction being the direction of slackening;

the tool is one having two directions of use, especially one of the ring-spanner type, one of the directions favoring the safeguarding of the driven member and the other direction favoring the ability of the tool to apply high torque.

Exemplary embodiments of the invention will now be described with regard to the appended drawings in which.

DETAILED DESCRIPTION OF THE INVENTION

In each of FIGS. 1 to 4, O designates the center of the cross-section of a head of a tool, which head has a roughly hexagonal profile, only approximately one third of the perimeter of which has been shown. In each case, a description will be made of one side 1 of the profile, which extends between two virtual corners and, seen from the point O, at an angle of 60° delimited by two radii 2 and 3.

Figure 1:
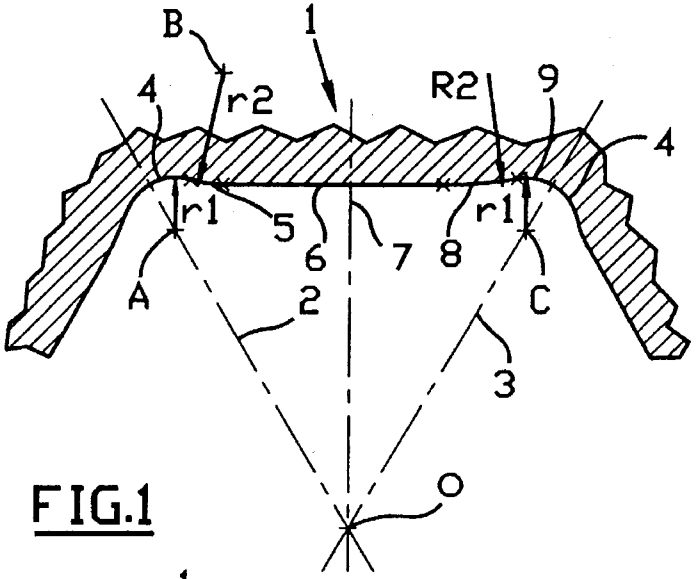
FIGS. 1 to 4 represent, seen from above, part of the active profile of four different tools in accordance with the invention.

In the example of FIG. 1, the side 1 comprises, in succession, from left to right in the drawing:

a concave circular arc 4 constituting a part of the corner fillet, of relatively small radius r, centered at A on the radius 2;

a convex circular arc 5, of radius r2 which is also relatively small although, in this example, greater than the radius rl. Arc 5 is joined tangentially to the arc 4 and is centered at B, outside the profile;

a straight segment 6 perpendicular to the bisector 7 of the radii 2 and 3, being joined tangentially to the arc 5;

a convex circular arc 8, of radius R2 very much greater than the radius r2, being joined tangentially to the segment 6; and a concave circular arc 9, of radius close to, and preferably smaller than, rl, centered at C on the radius 3 or in the vicinity of this radius and being joined tangentially to the arc 8 as well as to the arc 4 on the adjacent side of the profile.

Figure 2:
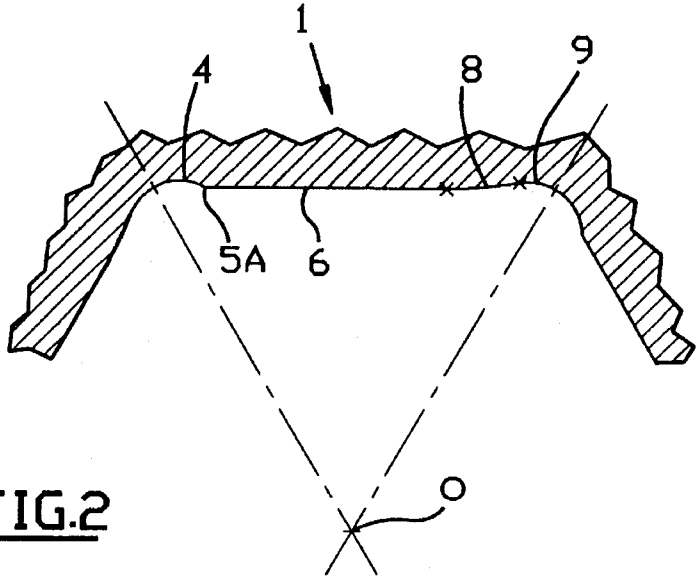

In the example of FIG. 2, the profile differs from the previous one only by the fact that r2=0, that is to say the arc 5 is replaced by a sharp edge 5A.

Figure 3:
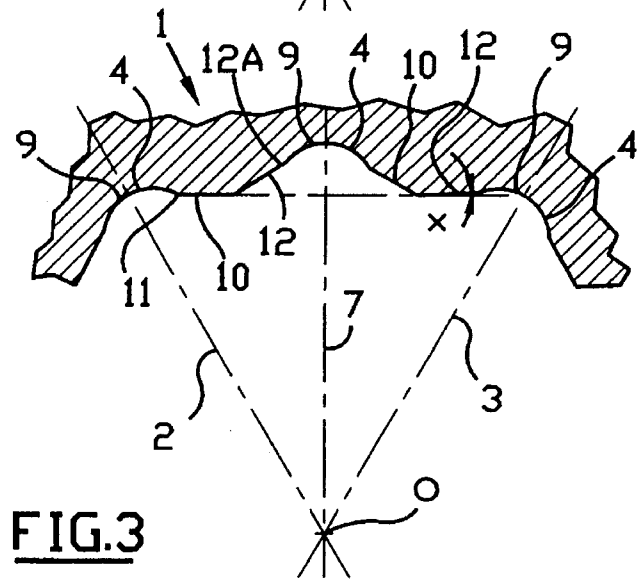

In the example of FIG. 3, the profile possesses twelve lilleted corners defined, as previously, by two circular arcs 4 and 9 of radius r1 and spaced apart angularly by 30°. Two straight segments, a segment 10 which is joined to the arc 4 by a sharp edge 11 and a segment 12 which is joined to the arc 9 by a sharp edge 12A, lie between the right end of an arc 4 and the left end of the following arc 9.

Considering two sides of the profile, that is to say the profile portion lying between the radii 2 and 3, there are thus, in succession, from left to right, an arc 4, a segment 10, a segment 12, an arc 9, an arc 4, a segment 10, a segment 12 and an arc 9. The left-hand segment 10 is perpendicular to the bisector 7, whereas the right-hand segment 12 has its left end on the prolongation of the left-hand segment 10 but diverges slightly from this prolongation, at a small angle x which is typically of the order of 3°.

Figure 4:
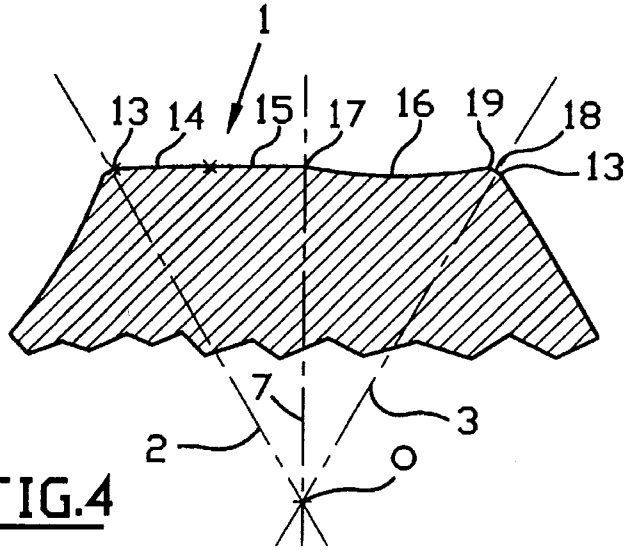

FIG. 4 shows the approximately hexagonal profile of a male tool head, the side 1 of which comprises, from left to right:

a corner half-fillet 13 constituted by a convex circular arc of radius r which is as small as possible, centered in the vicinity of the radius 2;

a convex circular arc 14 of large radius, being joined tangentially to the previous one;

a straight segment 15, being Joined tangentially to the arc 14, perpendicular to the bisector 7 and extending substantially as far as the latter;

an undercut 16 constituted by a concave circular arc of large radius, being joined to the segment 15 by a sharp edge 17; and a corner half-fillet 18 of radius r, being joined to the arc 16 by a sharp edge 19 and, on the other side, being Joined up tangentially to the half-fillet 13 on the following side of the profile.

Figure 5A:
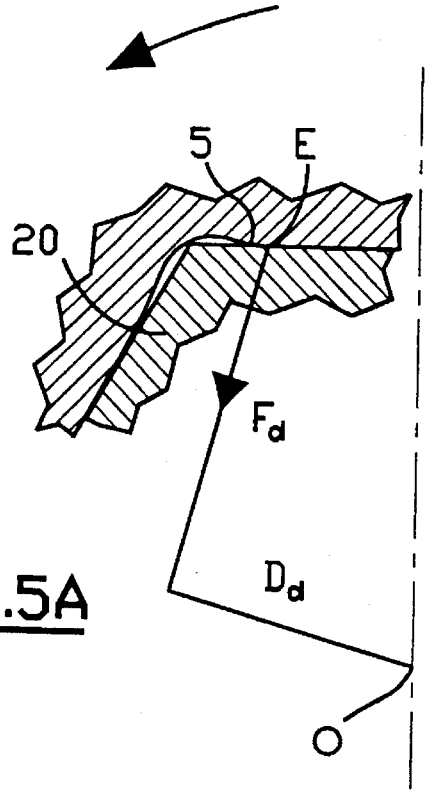
FIG. 5A illustrates the unscrewing of a nut by means of a female tool according to FIG. 1, assuming that the dimensions of the tool have their minimum values and those of the nut their maximum values.
Figure 5B:
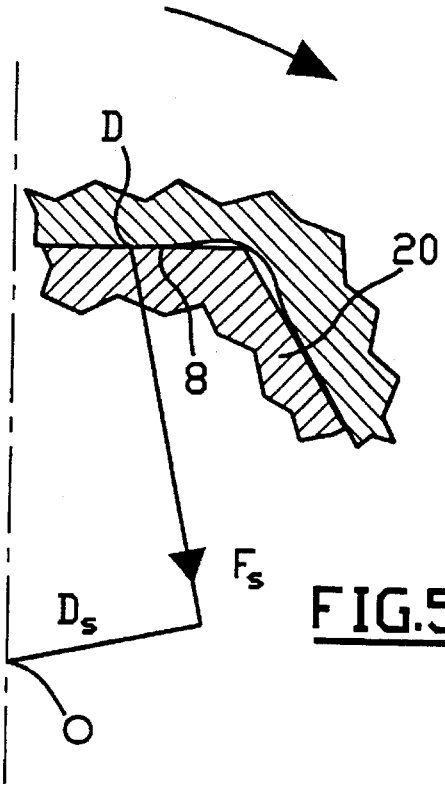
FIG. 5B illustrates the tightening of the same nut by means of the same tool.

A description will now be given, with regard to FIGS. 5A and 5B, of the use of the tool of FIG. 1 for tightening and slackening a hexagonal nut 20, in the case of a tool of minimum dimensions and of a nut of maximum dimensions, that is to say with a minimum clearance between the tool and the nut.

In the direction of tightening (FIG. 5B), each side of the tool drives the corresponding side of the nut via a point D on the large-radius arc 8 located in the vicinity of the left end thereof. In the direction of slackening (FIG. 5A), it is, likewise, a point E on the arc 5 close to the right end thereof that drives the nut.

Because of the large difference between the radii r2 and R2 of the arcs 5 and 8 and because of the tangential connections of these two arcs at the adjacent parts of the profile of the tool, the tightening force $F_t$ is applied nearer the middle ,of the side, and is less inclined with respect to the bisector 7, than the slackening force $F_s$. This results in a longer lever arm when slackening ($D_s$) than when tightening ($D_t$).

Figure 5C:
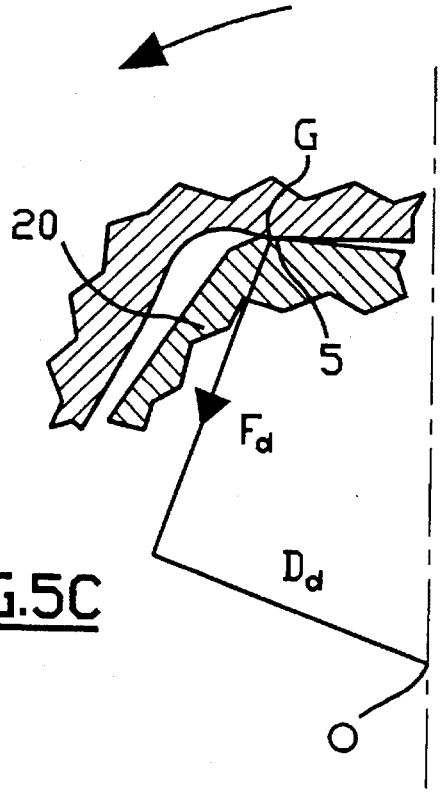
FIGS. 5C and 5D are, respectively, similar views to FIGS. 5A and 5B, but corresponding to the case where the dimensions of the tool have their maximum values and those of the nut their minimum values.
Figure 5D:
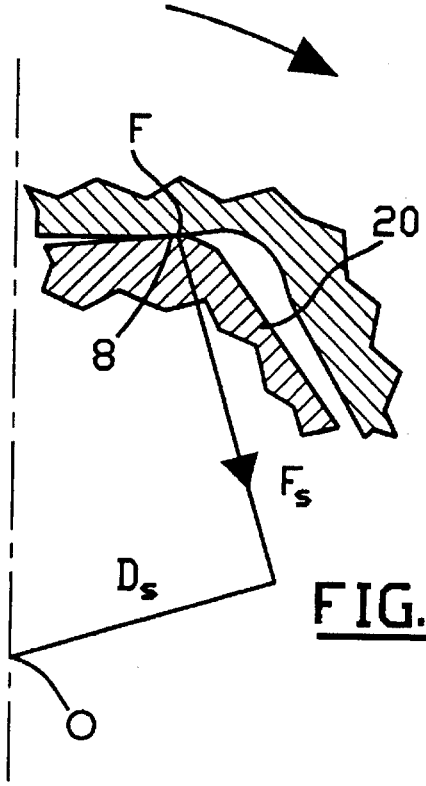
Figure 6A:
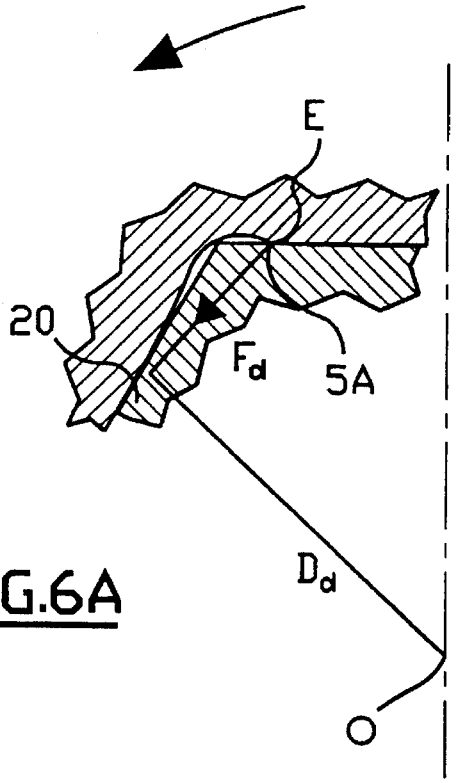
FIGS. 6A to 6D are, respectively, views similar to FIGS. 5A to 5D, but corresponding to the female tool according to FIG. 2.
Figure 6B:
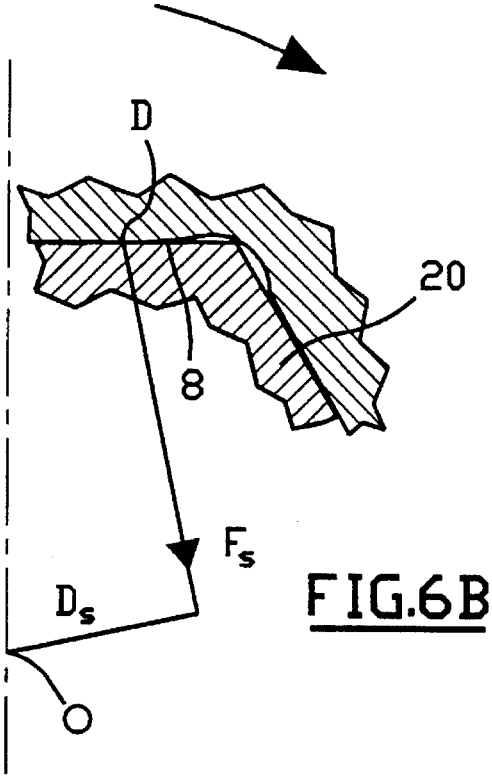
Figure 6C:
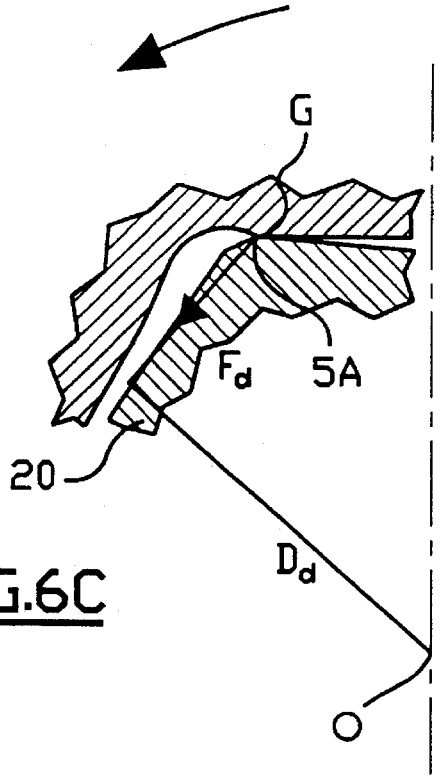
Figure 6D:
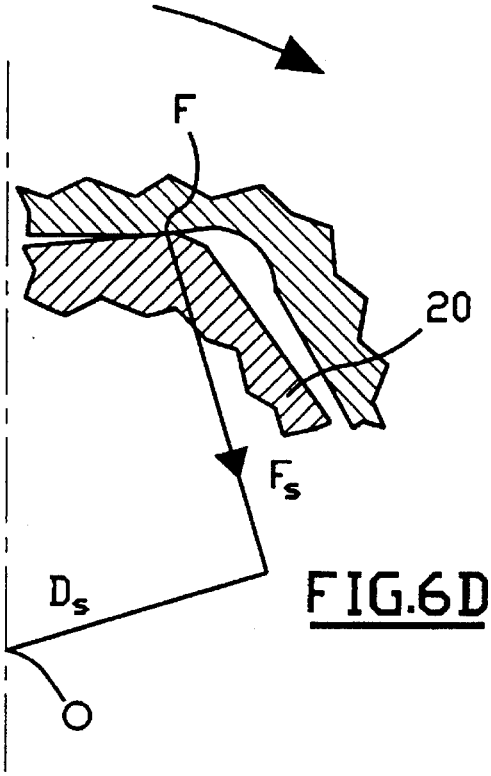

In the situation of maximum clearance, that is to say with the tool having the maximum dimensions and the nut having the minimum dimensions (FIGS. 5C and 5D), the tool acts, in each direction, very near the end of the side of the nut. In the direction of tightening (FIG. 5D), it acts via a point F close to the right end of the arc 8 and, in the other direction (FIG. 5C), via a point G close to the left end of the arc 5.

Once again, the significant difference between the radii r2 and R2 leads to a markedly greater lever arm in the direction of slackening, because of a steeper inclination of the forces.

In both cases, but more particularly when the nut and the tool are of high quality, that is to say when the clearance is small, the contact force is greater on tightening. This leads to greater stresses in the tool, but the way in which the force is applied to the nut has the result that the preservation of the nut is enhanced when tightening.

On the contrary, when slackening, the phenomenon is reversed: the ability of the tool to transmit a high torque is enhanced by a reduction in the contact force and by its better orientation. However, the nut is stressed more, to the point that, if the torque applied greatly exceeds the values deemed to be normal, it will no longer be possible to envisage the nut being reused.

The other examples which follow show other applications leading, to various degrees, to the same results.

Thus, similar considerations apply to the tool profile of FIG. 2 (FIGS. 6A to 6D), but the replacement of the arc 5 by the sharp edge 5A accentuates the phenomena described, the slackening force being even more inclined, because of the increase in the Hertzjan stress, and being even further away from the middle of the side.

Figure 7A:
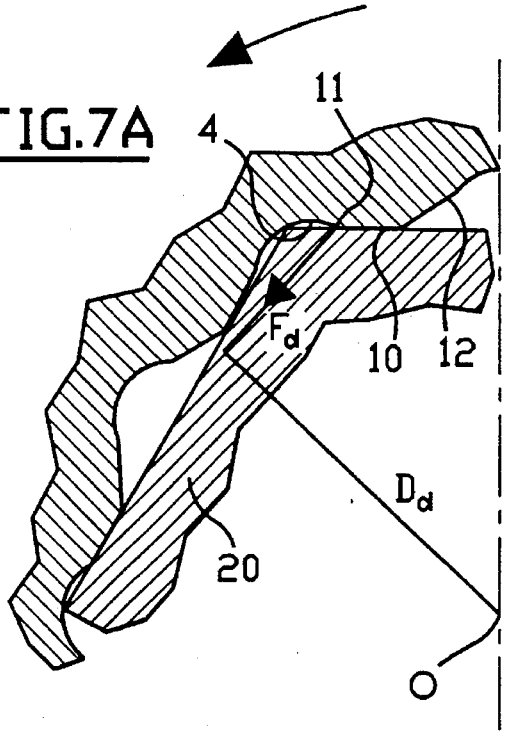
FIGS. 7A to 7D are, respectively, views similar to FIGS. 5A to 5D, but corresponding to the female tool according to FIG. 3.
Figure 7B:
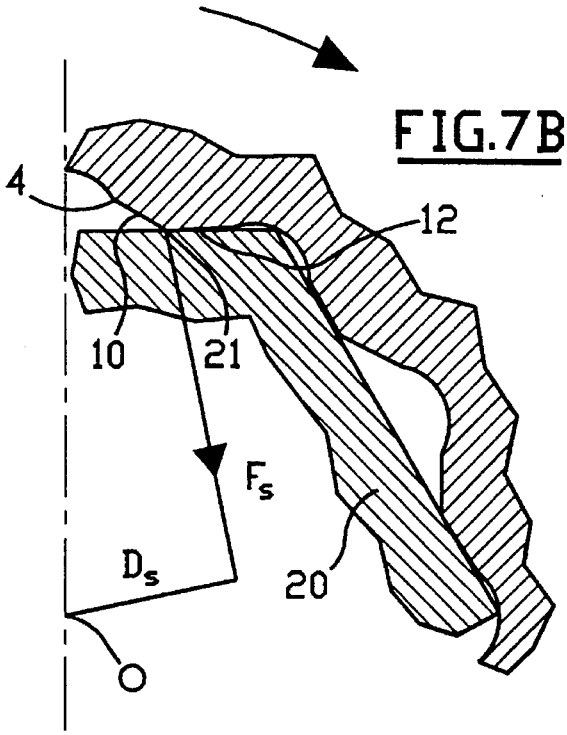
Figure 7C:
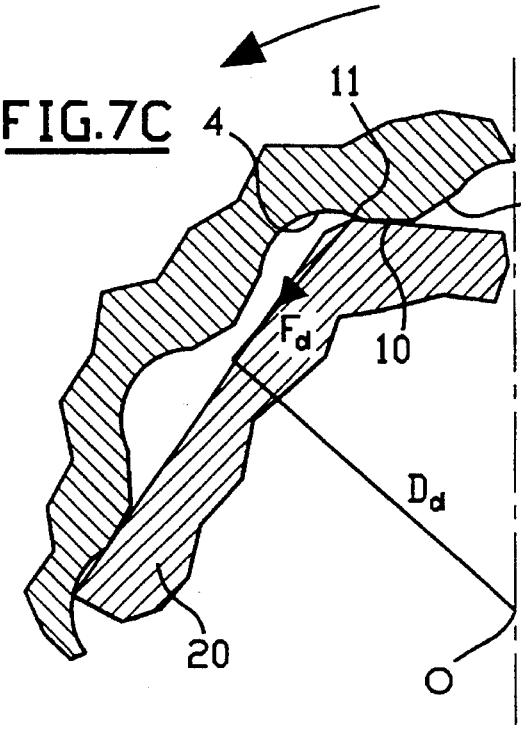
Figure 7D:
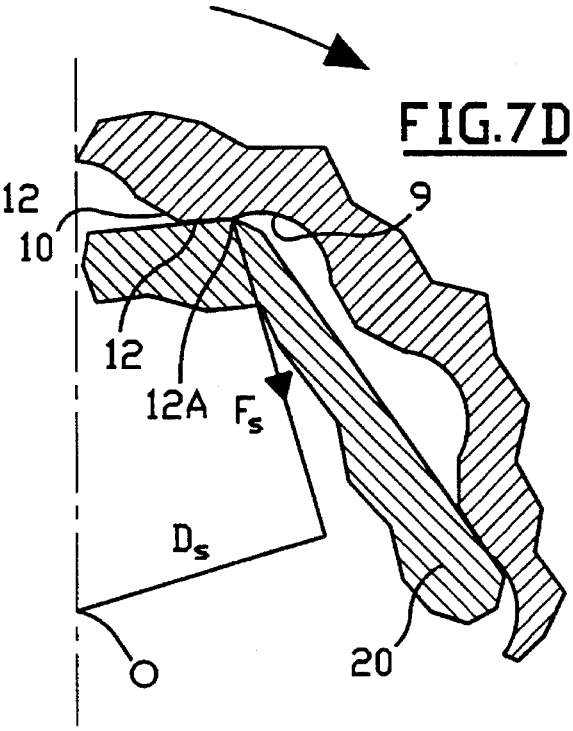

In the case of the tool of FIG. 3, (FIGS. 7A to 7D), in the "minimum clearance" situation, the side of the nut is driven, when tightening (FIG. 7B), via the sharp edge 21 connecting the segments 10 and 12 and, when slackening (FIG. 7A), via the sharp edge 11 connecting the segment 10 and the circular arc 4. Thus, by virtue of the difference in orientation between the segments 10 and 12 which was described above, the point of application of the force is further away from the middle of the side upon slackening, and the force is more inclined, which leads to a greater lever arm in this direction.

In the "maximum clearance" situation, the tool, in both directions, drives the nut near the end of the side of the latter. When tightening (FIG. 7D), it acts via the sharp edge 12A connecting the segment 12 and the arc 9 and, when slackening (FIG. 7C), via the sharp edge 11 connecting the segment 10 and the arc 4. In this case, the different inclination of the segments 10 and 12 leads to a steeper inclination of the force $F_s$ and ends up with a greater lever arm in the direction of slackening.

It should be noted that, in each case described hereinabove, the consequence of the steeper inclination of the force when slackening is that, for a given slackening torque exerted on the nut, the force for bursting the female tool is reduced. In other words, the torque which can be applied to the nut is greater in the direction of slackening before destroying the head of the tool by bursting.

Figure 8A:
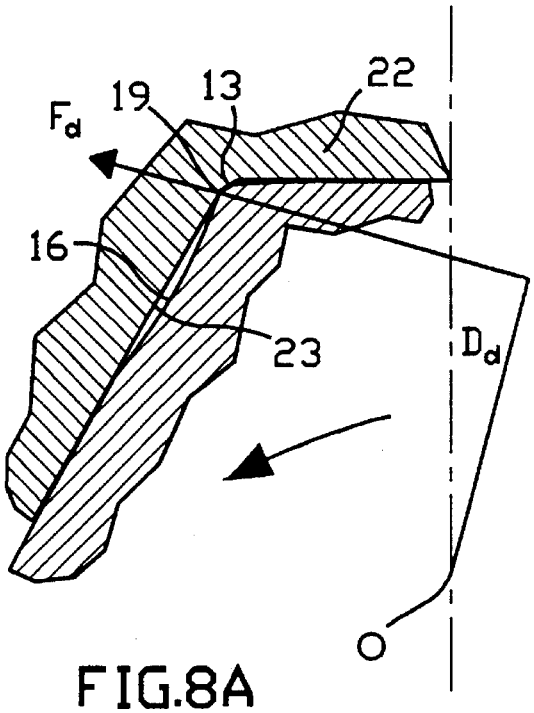
FIG. 8A illustrates the slackening of a screw by means of a male tool according to FIG. 4, assuming that the dimensions of the tool have their maximum values and those of the recess for driving the screw their minimum values.
Figure 8B:
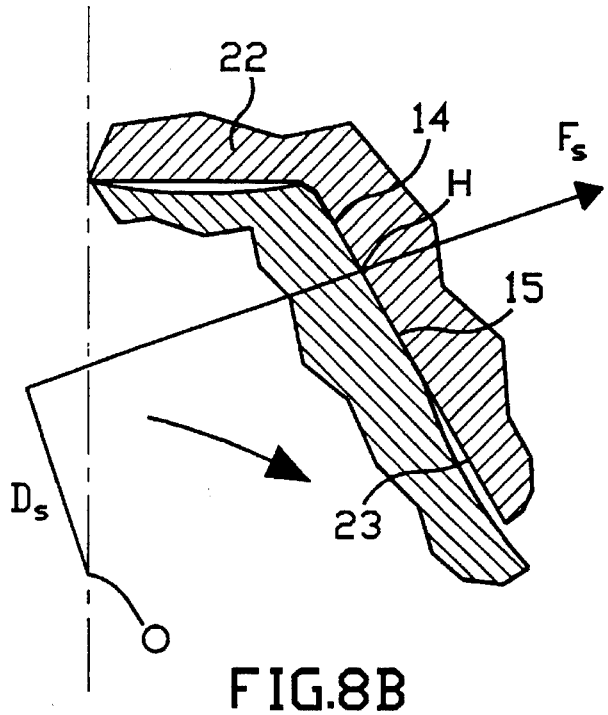
FIG. 8B illustrates the tightening of the same screw by means of the same tool.
Figure 8C:
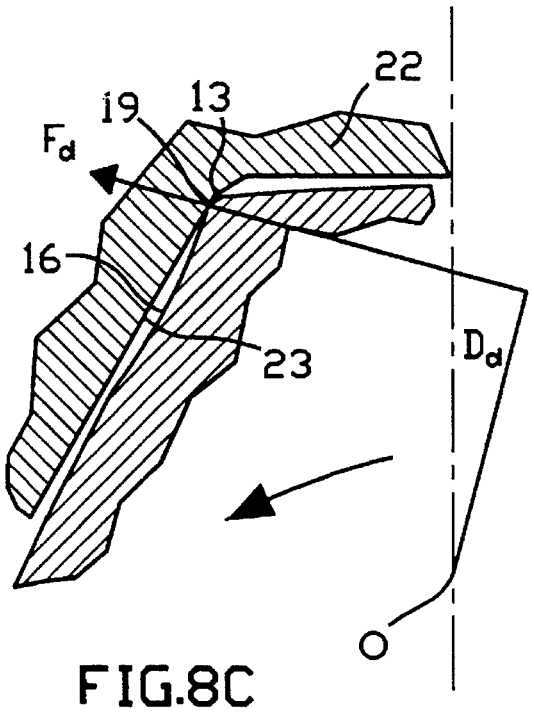
FIGS. 8C and 8D are, respectively, views similar to FIGS. 8A and 8B, but corresponding to the case where the dimensions of the tool have their minimum values and those of the recess for driving the screw their maximum values.
Figure 8D:
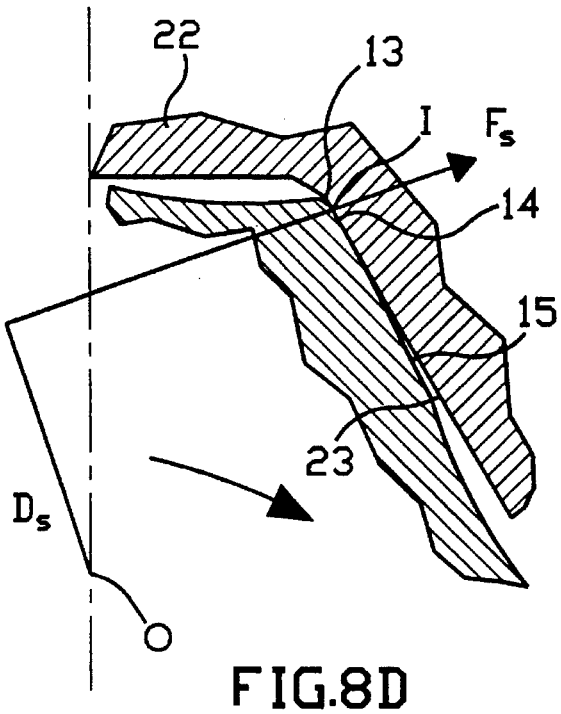

In the case of the male tool of FIG. 4, when tightening (FIGS. 8B and 8D), the hex-socket 23 bolt 22 is driven via a point H on the large-radius convex arc 14 located near the segment 15 in the "minimum clearance" situation (FIG. 8B) and via a point I on the same arc located near the fillet 13 in the "maximum clearance" situation (FIG. 8D). When slackening (FIGS. 8A and 8C), the point of contact is the sharp edge 19 of intersection of the fillet 13 and of the concave arc 16. Thus, in all cases, the inclination of the force and the Hertzian stress are greater when slackening and, in addition, in the "minimum clearance" situation, the point of application of the force is further away from the middle of the side upon slackening. Consequently, once again, the slackening torque which can be applied is greater than the tightening torque which can be applied before destroying the head of the tool, which means, in this case, before rounding of the polygonal profile of the tool.

I claim:

1. A tool for tightening and slackening a driven threaded member possessing a polygonal driven profile, said tool comprising:

an active head having a cross section of roughly polygonal shape;

at least two sides of said cross section of said head of said tool being formed by two half-sides; and active zones of each of said half-sides being constituted, for both opposite directions of rotation of said tool, by fillets or sharp edges interacting with plane faces of the polygonal profile, and have general shapes which are mutually asymmetrical with respect to an axial mid-plane of said each side, so that, for a given torque applied to said tool, stresses induced in said tool are smaller in a first said direction than in an opposite second said direction, whereas, conversely, stresses induced in the driven member are larger in said first direction than in said second direction, which makes it possible to apply, to the driven member, a greater torque in said first direction than in said second direction before destroying said head of said tool.

2. A tool as claimed in claim 1, wherein the asymmetry of said two half-sides defines, in said first direction, a lever arm greater than that corresponding to said second direction.

3. A tool as claimed in claim 2, wherein the difference in lever arm is obtained by a difference in distance to said axial mid-plane of respective said active zones of said two half-sides by a difference in inclination of said zones with respect to said axial mid-plane.

4. A tool as claimed in claim 3, wherein contact of each said side with the driven profile is brought about by a surface of smaller radius in said first direction than in said second direction.

5. A tool as claimed in claim 2, wherein the contact of each said side with the driven profile is brought about by a surface of smaller radius in said first direction than in said second direction.

6. A tool as claimed in claim 5, wherein a contact surface of each said side in said first direction is reduced to a sharp edge.

7. A tool as claimed in claim 1, having an imposed direction of use, said first direction is the direction of slackening thereby.

8. A tool as claimed in claim 1, having two directions of use, of said directions favoring safeguarding of the driven member and the other of said directions favoring the ability of said tool to apply high torques.

* * * * *